US006536912B2

(12) United States Patent
Parker

(10) Patent No.: US 6,536,912 B2
(45) Date of Patent: Mar. 25, 2003

(54) MULTI-CELL LED FLASHLIGHT

(75) Inventor: David H. Parker, Torrance, CA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

(21) Appl. No.: 09/832,763

(22) Filed: Apr. 11, 2001

(65) Prior Publication Data

US 2002/0149930 A1 Oct. 17, 2002

(51) Int. Cl.[7] ..... F21L 4/04
(52) U.S. Cl. ..... 362/206; 362/202; 362/208
(58) Field of Search ..... 362/202, 205, 362/206, 396, 204, 208

(56) References Cited

U.S. PATENT DOCUMENTS 5,904,414 A * 5/1999 Monteleone et al. ..... 362/202
6,017,129 A * 1/2000 Krietzman ..... 362/202
6,092,910 A * 7/2000 Sung ..... 362/206
6,283,611 B1 * 9/2001 Sharrah et al. ..... 362/206
6,296,371 B1 * 10/2001 Shiau ..... 362/206
6,347,878 B1 * 2/2002 Shiao ..... 362/206
6,371,625 B2 * 4/2002 Campman ..... 362/206

* cited by examiner

*Primary Examiner*—Y. My Quach-Lee
*Assistant Examiner*—Peggy A Neils
(74) *Attorney, Agent, or Firm*—Greenberg Traurig, LLP

(57) ABSTRACT

A flashlight includes battery cells and an LED light source. A switching device is at the base of the barrel and the bottom of the battery. A head is located above the barrel. A housing holds the LED, and the cells are on a tray associated with the housing, and filtered in the body to be removable when the head is separated from the body.

3 Claims, 3 Drawing Sheets

FIG. 1
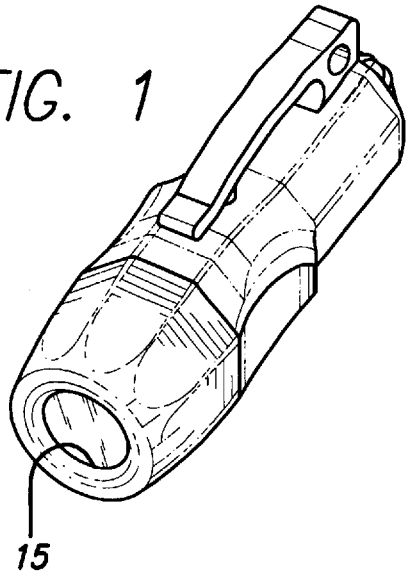
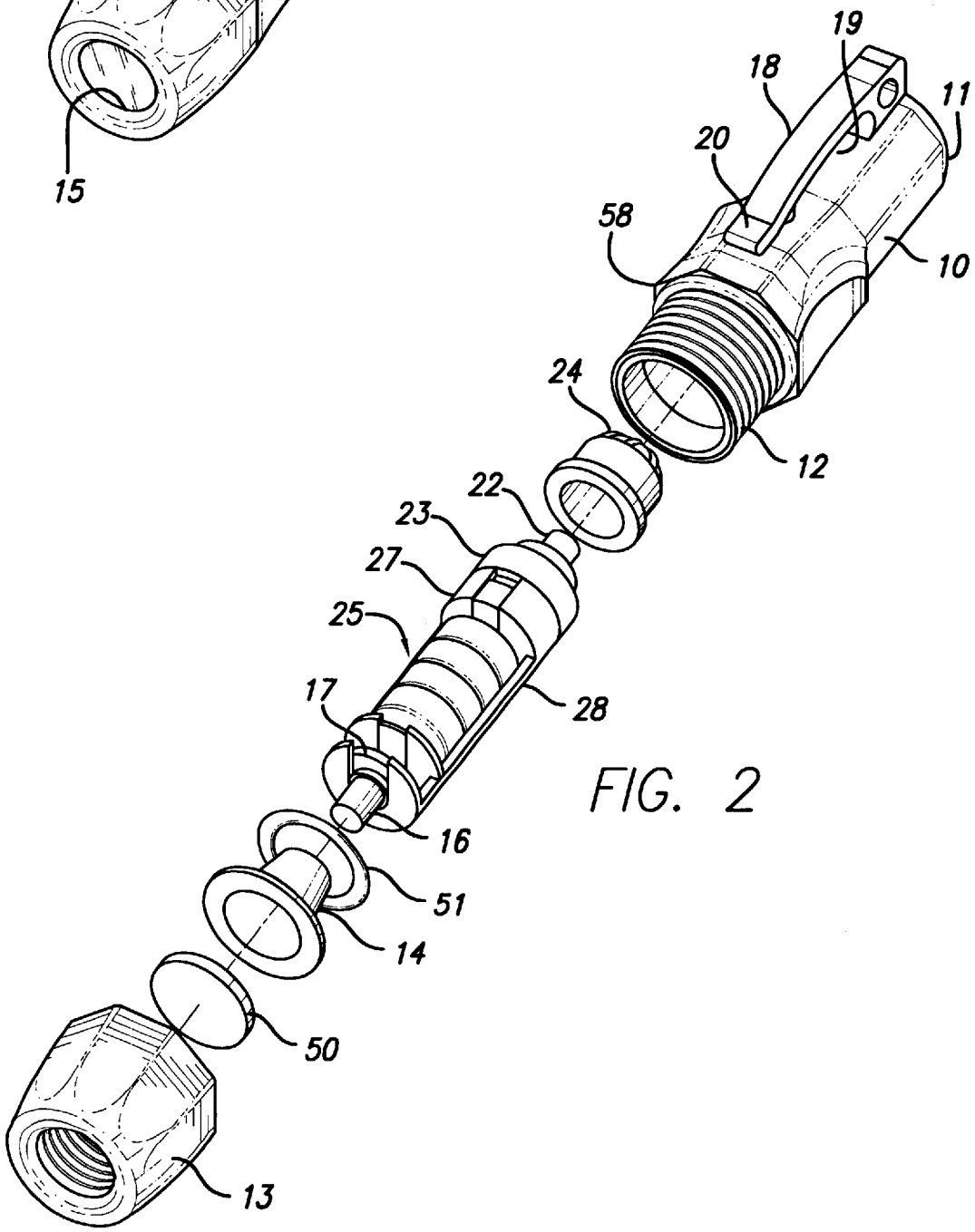
FIG. 2

MULTI-CELL LED FLASHLIGHT

BACKGROUND OF THE INVENTION

This invention relates to a flashlight. In particular, it relates to a flashlight for use to exhibit a strong light source.

Many flashlight configurations are known. The various known flashlights are often not as simple and inexpensive to manufacture as desirable, while at the same time having effective characteristics of a strong light source, longevity and an ability to work reliably in appropriate conditions.

The invention is directed to providing a flashlight which minimizes the disadvantages of known flashlights.

SUMMARY OF THE INVENTION

By the present invention, there is provided a flashlight which minimizes the disadvantages of known flashlights.

A battery flashlight is provided. The flashlight has a body with a barrel and a head. There are contacts between an LED light source and multiple cells in a portion above the barrel. A switch device is located at the bottom of the barrel. A spring is located on the underside of a housing for mounting the LED of the flashlight. Above the housing and the LEDs there is a cap which screws onto the barrel and the cap forms the head.

At the bottom of the barrel, and below the battery cells there is the switch for operating the flashlight. The switch is mounted on a tray which holds the cells and at the top of the tray there is the housing mounting the LED.

The invention is further described with reference to the accompanying drawings.

BRIEF DESCRIPTION OF THE DRAWINGS

FIG. 1 is perspective view of the flashlight viewed from the front showing an octagonal body with a clip partially over the body.

FIG. 2 is an exploded view of the flashlight showing the barrel, the cover for the switch component, the switch component mounted at the foot of a tray for multiple cells in series relationships, the housing for the LED, the cap and lens configuration of the head.

DETAILED DESCRIPTION OF THE PREFERRED EMBODIMENT

Figure 3:
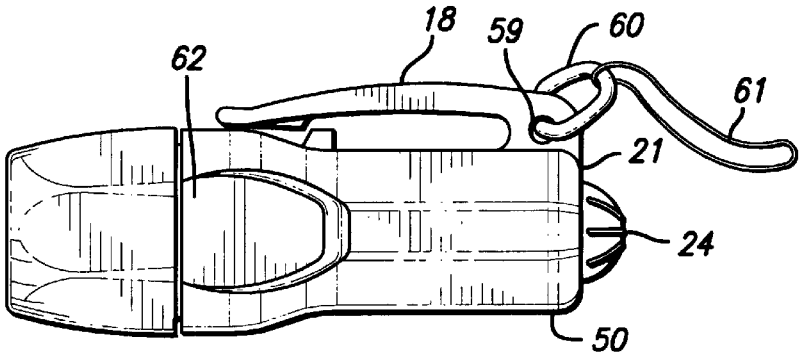
FIG. 3 is a side view of the flashlight showing the head, the body barrel and the cover for the switch.
Figure 4:
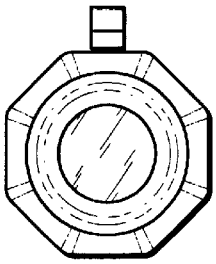
FIG. 4 is a front view of the flashlight showing the transparent plastic over the lens.

A flashlight includes a barrel body 10 which has a substantially regular outer cross-sectional octagonal area or faces as defined between the base 11 of the body 10 and a screw threaded top portion of the body as defined in the area 12. Above the body area 12 there is a head portion 13 which is relatively enlarged, and is located in regular relationship relative to the barrel body 10 for screw engagement with the top 12.

The head portion 13 includes a lens 14 and mounted centrally in an aperture 15 within the lens 14 there is an LED 16. The LED light source 16 is mounted on a housing board 17 which has an appropriate electronic circuit for regulating and governing the operation of the LED 16. The head 13 also includes a plastic circular cover 50 which sits on the top of the lens 14 and is anchored thereby an internal lip at the end of the head 13. There is also an O-ring 51 for effecting sealing of the head 13 and the barrel body 10.

The barrel body portion 10 includes a clip 18. The clip 18 is located substantially at the lowermost portion 11 of the body portion 10 and extends upwardly along one surface of the body 10 from the base portion 11 around the outside of the body portion 10. The clip 18 provides a receiving area 19 for receiving a support for the flashlight. The end of the clip 18 includes an inwardly directed lip 20 which closes the gap between the surface and the clip 18.

Figure 5:
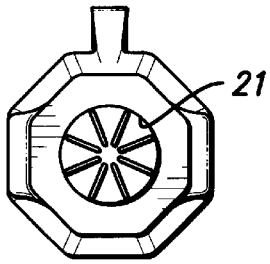
FIG. 5 is a rear view of the flashlight.
Figure 8:
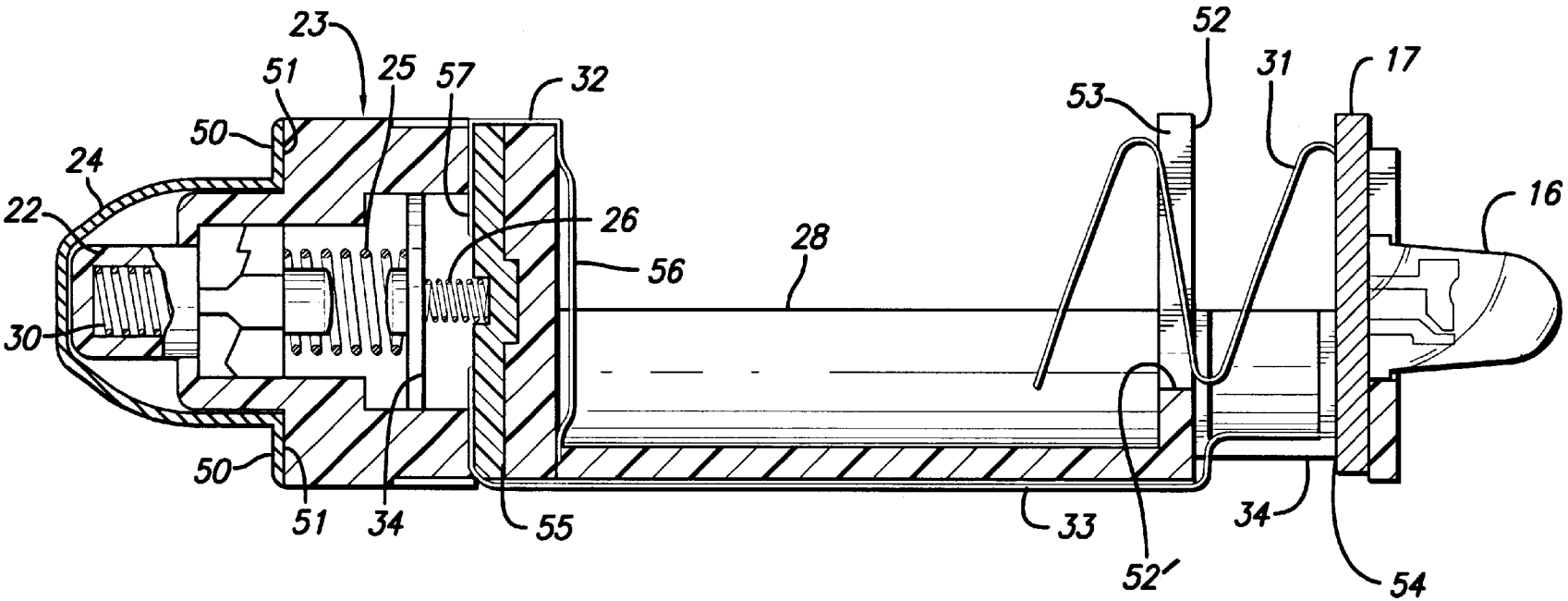
FIG. 8 is a cross-sectional view of the internal structure of the flashlight showing the switch, the components making up the switch, the tray for the cells, the spring between the housing holding the LED and for location with one side of the series of cells, and also the second contact.

At the base 11 there is provided a longitudinal circular aperture 21 (FIG. 5) through which a manually operable movable and partly hollow switching arm and push button 22 of a switch device or assembly 23 is located (FIG. 8). A switch pad button cover 24 is provided over the movable arm 22. The manually operable switch arm 22 can be depressed to activate a spring operated switch assembly so as to close and open electrical contacts in the switch device 23. The opposite end of the movable arm 22 of the switch device 23 is connected with a helical spring 25. The leading end of the switch device assembly 23 includes a centrally located helical spring 26, which is directed towards the base 27 of a tray 28 for a battery cell pack 29 (see also FIG. 2). There is also a spring 30 in the push button 22 (FIG. 8).

At the rear of the housing board 17 (FIG. 8) for the LED 16 there is a spring 31 which contacts the one portion of the electronic circuit on the housing board 17 and on the opposite part of the top of the series of cells 29. There are also two contact strips 32 and 33. Strip 33 runs up the inside side of the body 10. The strips 32 and 33 connect with the switch assembly 23 appropriately. The end of strip 33 connects electrically at the housing board 17 with one side of the LED 16 or the circuit associated with the LED 16. The opposite end of strip 32 connects with the base 27 of the cells 29.

Thus, when the operational arm and push button 22 of the switch 23 is pressed inwardly the plate mechanism 34 of the switch device assembly 23 is pressed downwardly to contact the ends of contact strips 32 and 33. The circuit connecting the battery cells 29 to the LED 16 is made or broken by the switch device assembly 23 and electrical contacts within the switch device assembly 23. It can be seen that the operation of the switch assembly 23 is longitudinal or relative to the longitudinal axis of the body 10 of the flashlight. The push button 22 acts longitudinally. The push button 22 is located in a longitudinally position relative to the battery cells 29 of the flashlight.

The forward end 52 of the tray 53 is provided with a slot 52' on one wall as is shown in FIG. 8. The spring 31 passes through the slot. The housing board 17 is provided with an electric circuit for operating the LED 16. The one end 54 of the strip 33 gauges the housing board 17 at the opposite end. The end 55 of the contact strip 33 is for engaging the circular contact plate 34 during the operation of the switch. Also contact strip 56 is for engaging the base of the cells and the portion 57 of the contact strip 32 engages the circular plate 34 when that plate is pushed into contact with the end 55 and 57.

The arrangement of the configuration is one where the tray 28 is inserted into the barrel 10 from the front end. The push button 22 extends out of a board in the base of the barrel. Between the push button 22 and the board at the base of the barrel there is the cover 24.

This cover acts to provide an effective seal to the base of the tray 28. Around the outside of the screw threaded top 12 there is provided a rubber O-ring 58 (FIG. 2) which engages the inside of the head 13 and creates an effective seal when the head 13 is screwed down on the top 12.

In one preferred form of the invention as shown, the overall size of the light barrel is about two inches with a diameter of about one inch. At the rear of the clip 18 there is an aperture 59 (FIG. 3) for receiving a spring ring 60 which in turn can be connected to a cord 61 to permit for carrying of the light.

Figure 6:
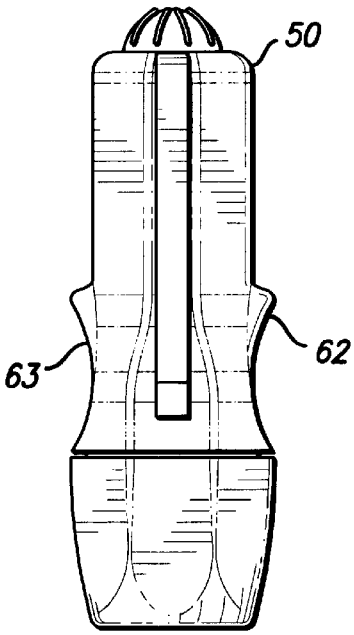
FIG. 6 is a top view of the flashlight.
Figure 7:
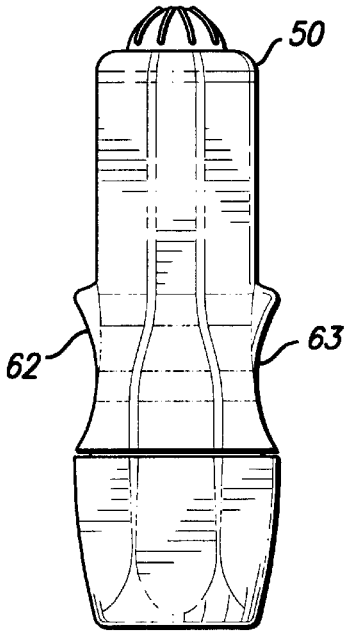
FIG. 7 is an underview of the flashlight.

Also on the outside of the barrel, there are two finger stripping zones 62 and 63 (FIG. 6), opposite sides. This facilitates the activation and holding of the light. The fingers can be secured in the stripping zones 62 and 63 in a manner similar to the holding of a pen and the thumb can then operate the cover 24, in an easy manner.

The cover 24 is provided to the push button 22 such as to provide for positive engagement by finger operation of a user. The cover 24 is formed with a circular lip 50 (FIG. 8) which engages the shoulder 51 on the housing for the switch. The cover 24 is made of a relatively flexible material so that it can be pushed inwardly to engage the button 22.

The operation of the switch assembly in a manner longitudinal to the longitudinal direction of the flashlight provides for effective and positive movement. By locating the switch 23 in the base of the barrel body 10 of the flashlight, there is an effective cross-sectional area to accommodate the switch device in a convenient place.

Many other forms of the invention exist, each differing from the other in matters of detail only.

The invention is to be determined solely upon the following claims.

What is claimed is:

1. A flashlight comprising:

a body for receiving a battery, the body having a longitudinal axis and a top and a base;

a head on the body having a lens and being for receiving an LED;

an LED coupled to a tray adapted to contain at least one battery therein;

a switch device with electrical contacts, the switch device being located towards the base of the body, the switch device acting to move inwardly and outwardly to open and close an electric circuit between the battery and the LED, said tray including a contact strip extending along the longitudinal length of the tray to the switch device, the switch device being mounted at the base of the tray, said switch device, said LED and said contact strip being mounted to said tray comprising a single complete assembly.

2. A flashlight as claimed in claim 1 wherein the switch device is operable to create the following conditions of the flashlight:

permanently on, permanently off and temporarily on under pressure from a finger urging closure of contacts in the switch and releasable from the temporarily on position on release of the finger pressure.

3. A flashlight as claimed in claim 1, the tray, switch device, LED and contact strip being removable from the body as a single unit.

* * * * *